US007171150B2

(12) United States Patent
Yonekawa

(10) Patent No.: US 7,171,150 B2
(45) **Date of Patent: *Jan. 30, 2007**

(54) BELT-TYPE FIXING DEVICE

(75) Inventor: Noboru Yonekawa, Toyohashi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/805,244

(22) Filed: Mar. 22, 2004

(65) Prior Publication Data

US 2004/0184849 A1 Sep. 23, 2004

(30) Foreign Application Priority Data

Mar. 20, 2003 (JP) ..... 2003-077079
Mar. 20, 2003 (JP) ..... 2003-077080

(51) Int. Cl.
*G03G 15/20* (2006.01)

(52) U.S. Cl. ..... 399/329; 399/333

(58) Field of Classification Search ..... 399/329, 399/328, 333, 400

See application file for complete search history.

(56) References Cited

U.S. PATENT DOCUMENTS

| | | | | |
|---|---|---|---|---|
| 5,011,401 | A * | 4/1991 | Sakurai et al. | 399/331 |
| 5,055,884 | A * | 10/1991 | Ndebi et al. | 399/328 |
| 5,999,788 | A * | 12/1999 | Kanesawa et al. | 399/329 |
| 6,408,160 | B1 * | 6/2002 | Saito et al. | 399/333 |
| 6,795,678 | B2 * | 9/2004 | Yura et al. | 399/329 |
| 6,864,461 | B2 * | 3/2005 | Okabayashi et al. | 399/329 |
| 2002/0085866 | A1 * | 7/2002 | Okayasu et al. | 399/328 |

FOREIGN PATENT DOCUMENTS

| | | | |
|---|---|---|---|
| JP | 60002972 | A * | 1/1985 |
| JP | 61238075 | A * | 10/1986 |
| JP | 3-228076 | | 10/1991 |
| JP | 05165371 | A * | 7/1993 |
| JP | 10-228195 | | 8/1998 |
| JP | 11-133776 | | 5/1999 |
| JP | 2001-356625 | | 12/2001 |
| JP | 2002-148979 | | 5/2002 |

* cited by examiner

*Primary Examiner*—Diego Gutierrez
*Assistant Examiner*—Travis Reis
(74) *Attorney, Agent, or Firm*—Morrison & Foerster LLP

(57) ABSTRACT

A belt-type fixing device is provided in which a nip pressure distribution in a fixing nip is made generally uniform with respect to a paper feeding direction and which thereby prevents occurrence of image noise even when a thick paper is fed.

The belt-type fixing device has: an endless-sheet-like fixing belt, a pressurizing roller which has elasticity and on which a paper is passed through a fixing nip that is contact part between the pressurizing roller and an outer circumferential surface of the belt member, and a nip forming member which is provided in contact with an inner surface of the fixing belt, which relatively presses the fixing belt against the pressurizing roller, of which an opposite surface pressing the pressurizing roller is formed as a curved surface extending along an outer circumferential surface of the pressurizing roller, and of which the opposite surface is composed of an elastic layer.

12 Claims, 8 Drawing Sheets

*Fig.4*

| ELASTIC LAYER THICKNESS (mm) | 0.1 | 0.3 | 0.5 | 0.7 | 1.0 | 1.5 |
|---|---|---|---|---|---|---|
| IMAGE NOISE | × | ○ | ○ | ○ | ○ | ○ |

*Fig.5*

| ELASTIC LAYER THICKNESS (mm) | 0.5 | 1.0 | 1.5 | 2.0 | 2.5 | 3.0 |
|---|---|---|---|---|---|---|
| DURABILITY | ○ | ○ | ○ | ○ | × | × |

*Fig.6*

| LOW-FRICTION LAYER THICKNESS (μm) | 2 | 5 | 10 | 20 |
|---|---|---|---|---|
| TORQUE INCREASE (Nm) | 0.45 | 0.1 | 0.05 | 0.05 |

*Fig.7*

| LOW-FRICTION LAYER THICKNESS (mm) | 0.1 | 0.2 | 0.3 | 0.4 |
|---|---|---|---|---|
| IMAGE NOISE | ○ | ○ | ○ | × |

*Fig.10*

| ELASTIC LAYER THICKNESS (mm) | 0.1 | 0.2 | 0.3 | 0.5 | 0.8 | 1.0 |
|---|---|---|---|---|---|---|
| IMAGE NOISE | × | × | ○ | ○ | ○ | ○ |

*Fig.11*

| ELASTIC LAYER THICKNESS (mm) | 0.3 | 0.5 | 0.8 | 1.0 | 1.2 | 1.5 |
|---|---|---|---|---|---|---|
| DURABILITY | ○ | ○ | ○ | ○ | × | × |

BELT-TYPE FIXING DEVICE

RELATED APPLICATIONS

This application is based on Japanese Patent Applications Nos. 2003-77079 and 2003-77080, the contents of which are incorporated herein by reference.

BACKGROUND OF THE INVENTION

The present invention relates to a belt-type fixing device that is used in an electrophotographic image forming apparatus.

In Japanese Patent Laid-Open Publications 2001-356625, HEI 11-133776, and 2002-148979 has been disclosed a belt-type fixing device 100, as shown in FIG. 12, that has a rotatable pressurizing roller 101 having an elastic layer 101*a* composed of sponge or rubber on an outer circumference thereof, a fixing-belt supporting part 102, and an endless-sheet-like fixing belt 103 wound around the fixing-belt supporting part 102.

In the belt-type fixing device 100, contact part between the pressurizing roller 101 and the fixing belt 103 forms a fixing nip 104. The fixing belt 103 is brought into pressure contact with a nip forming member 102*a* of the fixing-belt supporting part 102 by the pressurizing roller 101, so that the fixing belt 103 is rotated in a direction of an arrow D by the pressurizing roller 101 that is driven to rotate in a direction of an arrow C. The pressurizing roller 101 is heated by a heater lamp 105 that is a heat source provided in the pressurizing roller 101, and a temperature of the pressurizing roller 101 is thereby raised to a specified fixation temperature (e.g., to 180° C.). After the temperature of the pressurizing roller 101 is raised to the specified fixation temperature, in the belt-type fixing device 100, a recording medium 107 on which an unfixed toner image 106 has been formed is introduced into the fixing nip 104 in a paper feeding direction shown by an arrow E, and the toner image 106 is heated and fixed on the recording medium 107 while the recording medium is passed through the fixing nip 104. The use of the nip forming member 102*a* that is fixed so as to be incapable of rotating is intended for forming the fixing nip 104 having a large width in order to ensure sufficient nip time, and the use of nip forming member 102*a* that has a low heat capacity is intended for reduction in warm-up time.

The belt-type fixing device 100, however, has a problem as follows. In the belt-type fixing device 100, a nip pressure distribution that is not uniform with respect to the paper feeding direction causes a difference in quantity of deformation in the elastic layer 101*a* in the fixing nip 104, thus leads to variation in conveying velocity for the recording medium 107 in the fixing nip 104, and thereby results in occurrence of image noise, increase in torque, and the like.

On condition that a thick paper such as cardboard is fed, the elastic layer 101*a* in the fixing nip 104 deforms more greatly on entrance side and exit side than in center part because a radius of curvature of the paper abutting on the pressurizing roller 101 becomes slightly smaller than a radius of curvature of an outer circumferential surface of the pressurizing roller 101. Accordingly, the nip pressure distribution is heightened at both ends with respect to the paper feeding direction and is lowered in the center part with respect to the paper feeding direction. As a result, a problem arises in that there are caused the variation in conveying velocity for the recording medium 107 and thus image noise.

SUMMARY OF THE INVENTION

Therefore, an object of the present invention is to provide a belt-type fixing device in which a nip pressure distribution in a fixing nip is made generally uniform with respect to a paper feeding direction and which thereby prevents occurrence of image noise even when a thick paper is fed.

In order to achieve the object, in the first aspect of the invention, there is provided a belt-type fixing device comprising:

an endless-sheet-like fixing belt, a pressurizing roller which has elasticity and on which a paper is passed through a fixing nip that is contact part between the pressurizing roller and an outer circumferential surface of the fixing belt, and a nip forming member which is provided in contact with an inner surface of the fixing belt, which relatively presses the fixing belt against the pressurizing roller, of which an opposite surface pressing the pressurizing roller is formed as a curved surface extending along an outer circumferential surface of the pressurizing roller, and of which the opposite surface is composed of an elastic layer.

In the belt-type fixing device having above configuration in which the elastic layer is provided on the nip forming member, the elastic layer of the nip forming member deforms on occasion of feeding of a thick paper, so that a nip pressure distribution in the fixing nip is made generally uniform with respect to a paper feeding direction though nip pressures are slightly higher on entrance side and exit side of the fixing nip than in center part of the fixing nip. As a result, variation in paper conveying velocity is restrained and image noise is prevented.

In the belt-type fixing device of the first aspect of the invention, the elastic layer of the nip forming member may have a thickness of 0.3 to 2.0 mm.

In the belt-type fixing device of the first aspect of the invention, a low-friction layer having a thickness of 5 to 300 μm may be provided on the elastic layer of the nip forming member.

In the belt-type fixing device of the first aspect of the invention, a quantity of deformation of the pressurizing roller is preferably larger than a quantity of deformation of the elastic layer of the nip forming member.

In the belt-type fixing device of the first aspect of the invention, the fixing belt may be driven to rotate by the pressurizing roller that is driven to rotate.

The belt-type fixing device of the first aspect of the invention may further have a heating roller, and the fixing belt may be wound around the nip forming member and around the heating roller.

In the second aspect of the invention, there is provided a belt-type fixing device comprising:

an endless-sheet-like fixing belt including an elastic layer, a pressurizing roller which has elasticity and on which a paper is passed through a fixing nip that is contact part between the pressurizing roller and an outer circumferential surface of the fixing belt, and a nip forming member which is provided in contact with an inner surface of the fixing belt, which relatively presses the fixing belt against the pressurizing roller, and of which an opposite surface pressing the pressurizing roller is formed as a curved surface extending along an outer circumferential surface of the pressurizing roller.

In the belt-type fixing device having above configuration in which the elastic layer is provided in the fixing belt, the elastic layer of the fixing belt deforms on occasion of feeding of a thick paper, so that a nip pressure distribution in the fixing nip is made generally uniform with respect to a paper feeding direction though nip pressures are slightly higher on entrance side and exit side of the fixing nip than in center part of the fixing nip. As a result, variation in paper conveying velocity is restrained and image noise is prevented.

In the belt-type fixing device of the second aspect of the invention, the elastic layer of the fixing belt may have a thickness of 0.3 to 1.0 mm.

In the belt-type fixing device of the second aspect of the invention, a mold release layer may be provided on the elastic layer of the fixing belt.

In the belt-type fixing device of the second aspect of the invention, the fixing belt may be driven to rotate by the pressurizing roller that is driven to rotate.

The belt-type fixing device of the second aspect of the invention may further have a heating roller, and the fixing belt may be wound around the nip forming member and around the heating roller.

In the third aspect of the invention, there is provided a belt-type fixing device comprising:

an endless-sheet-like fixing belt, a pressurizing roller which has elasticity and on which a paper is passed through a fixing nip that is contact part between the pressurizing roller and an outer circumferential surface of the fixing belt, a nip forming member which is provided in contact with an inner surface of the fixing belt, which relatively presses the fixing belt against the pressurizing roller, and of which an opposite surface pressing the pressurizing roller is formed as a curved surface extending along an outer circumferential surface of the pressurizing roller, and an elastic member which is provided in contact part of the nip forming member abutting on the fixing belt and of which a surface opposite to the pressurizing roller has a radius of curvature substantially equal to a radius of curvature of the outer circumferential surface of the pressurizing roller.

BRIEF DESCRIPTION OF THE DRAWINGS

The present invention will be further described with reference to the accompanying drawings wherein like reference numerals refer to like parts in the several views, and wherein:

FIG. 4 is a table showing a relation between thicknesses of an elastic layer of a nip forming member and occurrence of image noise;

FIG. 5 is a table showing a relation between thicknesses of the elastic layer of the nip forming member and durability;

FIG. 6 is a table showing a relation between thicknesses of a low-friction layer of the nip forming member and amounts of increase in torque;

FIG. 7 is a table showing a relation between thicknesses of the low-friction layer of the nip forming member and occurrence of image noise;

FIG. 10 is a table showing a relation between thicknesses of an elastic layer of the fixing belt and occurrence of image noise;

FIG. 11 is a table showing a relation between thicknesses of the elastic layer of the fixing belt and durability of the belt.

DETAILED DESCRIPTION OF THE PREFERRED EMBODIMENTS

Figure 1:
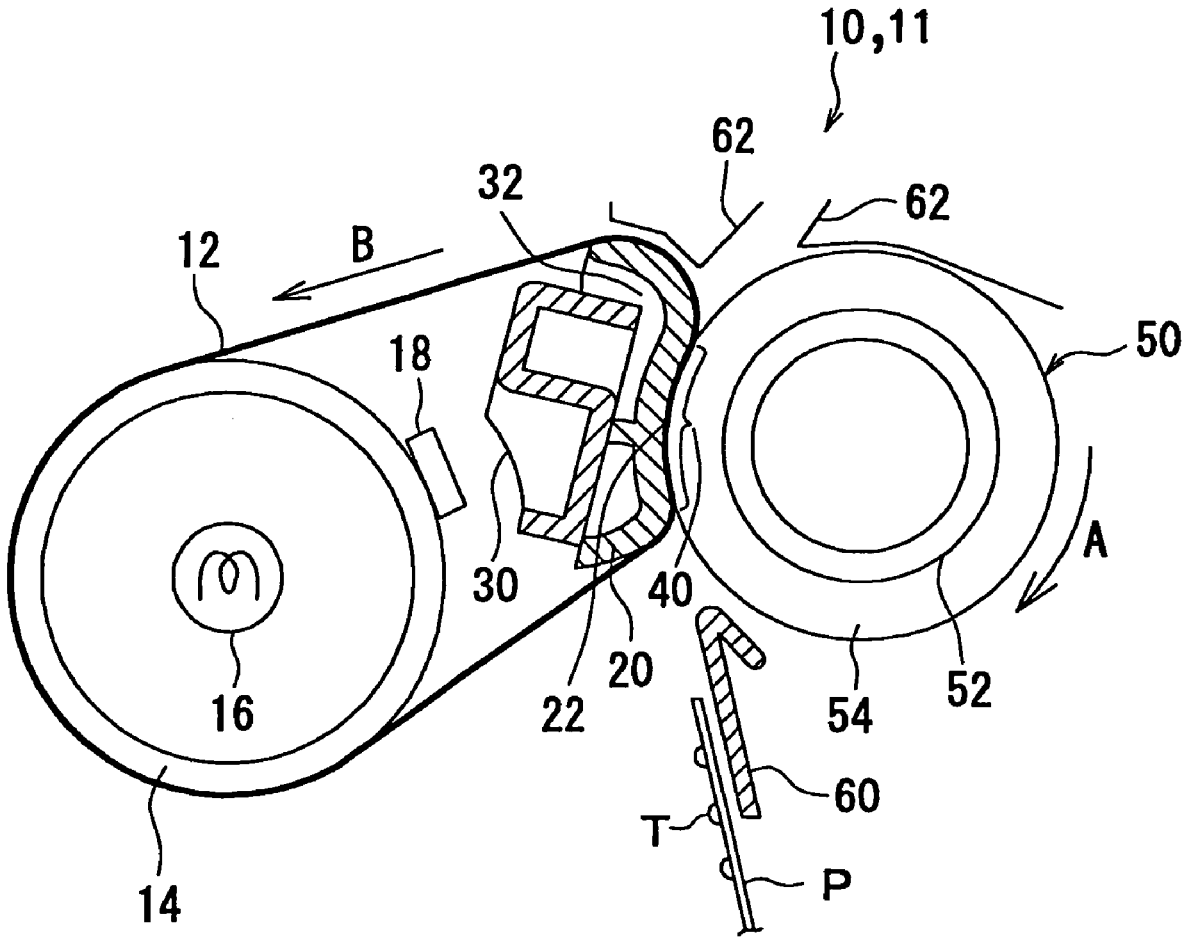
FIG. 1 shows a configuration of a belt-type fixing device in accordance with a first embodiment.

FIG. 1 shows a belt-type fixing device 10 in accordance with a first embodiment of the invention. The belt-type fixing device 10 has an endless-sheet-like fixing belt 12. The fixing belt 12 has an outside diameter of 50 mm in form of a cylinder, for example, and is composed of a 70 μm-thick base material made of PI (polyimide), a 200 μm-thick elastic layer made of silicone rubber, and a 30 μm-thick mold release layer made of PFA (copolymer of tetrafluoroethylene and perfluoroalkyl vinylether), for example, which are superimposed in order of mention from inside.

The fixing belt 12 is wound around a heating roller 14 that is rotatably supported at both ends thereof and around a nip forming member 20 that is fixed in a position away from the heating roller 14 so that the member 20 cannot be rotated. The heating roller 14 is composed of a cylindrical metal tube having an outside diameter of 35 mm, for example, and has a heater lamp 16 as a heat source therein. The heating roller 14 is biased by a spring not shown in a direction such that the heating roller 14 goes away from the nip forming member 20, and a specified tension is thereby imparted to the fixing belt 12.

The fixing belt 12 is heated by the heating roller 14 heated from inside by the heater lamp 16. A thermistor 18 is provided so as to be in contact with the heating roller 14. Temperatures of the heating roller 14 and the fixing belt 12 can be set at desired values by on-off control over the heater lamp 16 according to a temperature detected by the thermistor 18.

The nip forming member 20 is positioned inside and in contact with the fixing belt 12, and a pressurizing roller 50 is in pressure contact with the nip forming member 20 with the fixing belt 12 interposed between. In other words, the nip forming member 20 relatively presses the fixing belt 12 against the pressurizing roller 50. Thus contact part between the fixing belt 12 and the pressurizing roller 50 forms a fixing nip 40.

The pressurizing roller 50 has, for example, an outside diameter of 30 mm, and has a 4 mm-thick elastic layer 54 composed of rubber or sponge on an outer circumference of a metal core 52 that is like a metal cylinder and that has an outside diameter of 22 mm. A 40 μm-thick mold release layer (not shown) is formed on a surface of the elastic layer 54. The pressurizing roller 50 is driven by a motor not shown so as to rotate in a direction of an arrow A. It is to be noted that an auxiliary heater may be provided inside the pressurizing roller 50.

The elastic layer 54 of the pressurizing roller 50 has a length of 240 mm, for example, along an axial direction (a direction of depth in FIG. 1). The fixing belt 12 has a width larger than the length of the elastic layer 54 so that the whole length of the elastic layer 54 of the pressurizing roller 50 is in pressure contact. The nip forming member 20 extends so as to support the whole width of the fixing belt 12.

Nip loads in the fixing nip 40 (i.e., pressure contact loads of the pressurizing roller 50) are set in a range from 160 to 240 N, which results in a mean pressure in the fixing nip 40 in a range not less than 50 kPa and not more than 250 kPa. The mean pressure less than 50 kPa prevents a driving force of the pressurizing roller 50 from being transmitted stably to the fixing belt 12, whereas the mean pressure greater than 250 kPa only increases a driving load on the fixing belt 12 and necessitates a motor having a larger power consumption.

Figure 2:
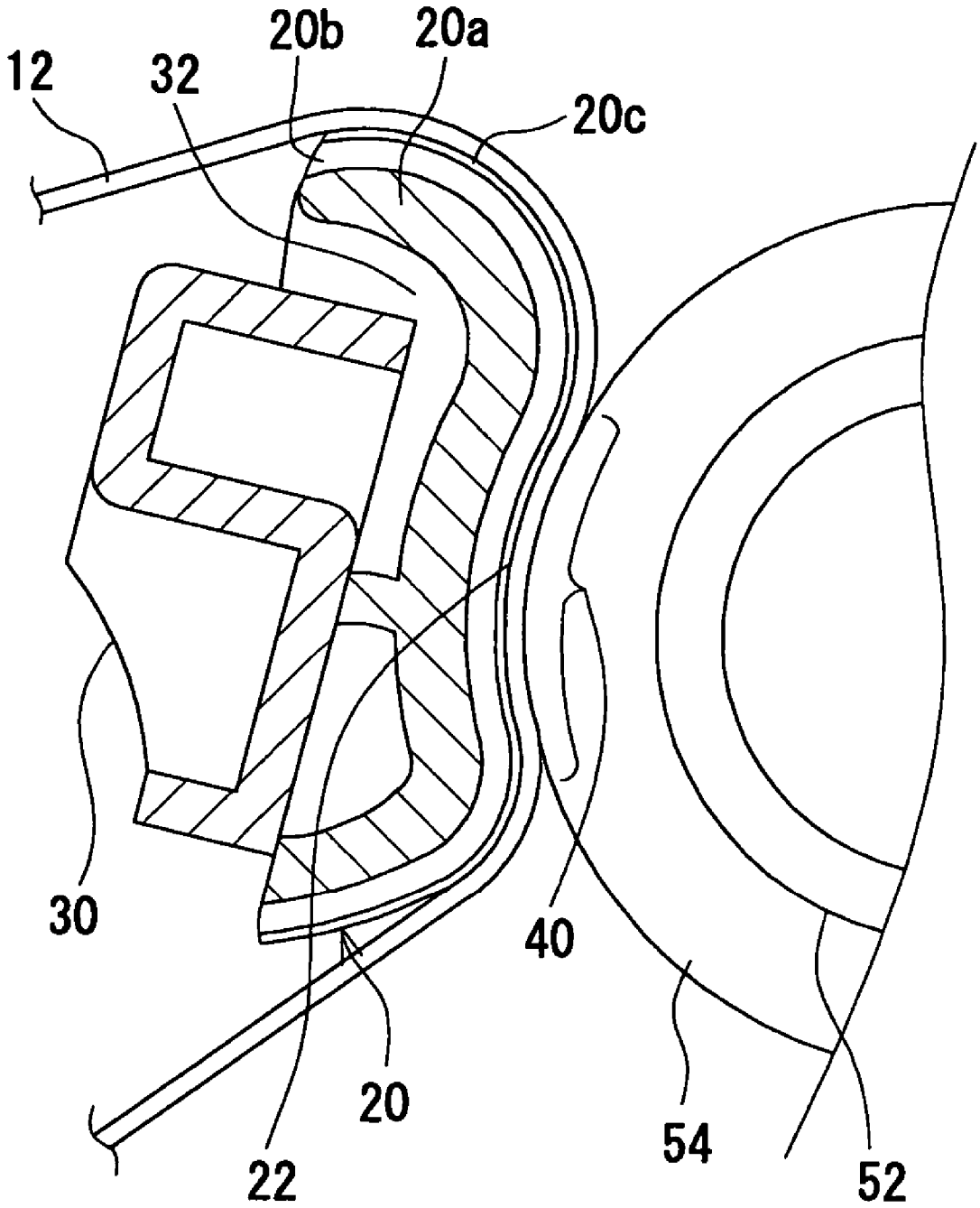
FIG. 2 is a fragmentary enlarged view of FIG. 1.

As shown in FIG. 2, the nip forming member 20 is composed of a base member 20*a*, an elastic layer 20*b* provided on the base member 20*a*, and a low-friction layer 20*c* provided on the elastic layer 20*b*. The base member 20*a* of the nip forming member 20 is formed of material that has a low thermal conductivity and that is sufficiently harder than the elastic layer 20*b*, such as heat-resistant resin and ceramic. The elastic layer 20*b* is composed of rubber, for example, and preferably has a thickness in a range from 0.3 to 2.0 mm. The low-friction layer 20*c* is composed of PFA, PTFE (polytetrafluoroethylene) or the like, for example, and preferably has a thickness in a range from 5 to 300 μm. In order to reduce a frictional resistance between the nip forming body 20 and the fixing belt 12, heat-resistant lubricant such as fluorine-based grease may be applied onto an inner surface of the fixing belt 12.

A surface 22 (i.e., a surface of the low-friction layer 20*c*) of the nip forming member 20 that is opposite to the pressurizing roller 50 is configured as a curved surface that extends along an outer circumferential surface of the pressurizing roller 50. Specifically, a radius of curvature of the opposite surface 22 of the nip forming member 20 is as large as a radius of curvature of the outer circumferential surface of the pressurizing roller 50 (e.g., 15 mm) or is a little larger (e.g., 15.4 mm) than that. In such a configuration, a length (what is called nip width) of the fixing nip 40 with respect to a circumferential direction of the pressurizing roller 50 is about 12 mm. Thus the surface 22 of the nip forming member 20 that is opposite to the pressurizing roller 50 is configured as the curved surface extending along the outer circumferential surface of the pressurizing roller 50, and a pressure distribution in the fixing nip 40 is thereby made generally flat with respect to a paper feeding direction. Paper conveying velocities are thus made uniform throughout the fixing nip 40. As a result, a paper passing through the fixing nip 40 is prevented from being stressed, and image noise such as image blur, wrinkles of paper and the like are thereby prevented from occurring. It is to be noted that the above-mentioned "generally flat" status includes status in which nip pressures are slightly higher in center part of the nip than on the entrance side and the exit side and status in which nip pressures are slightly higher on the entrance side and the exit side than in center part of the nip.

At back of the nip forming member 20, a reinforcing member 30 that is made of a metal plate bent into a cross-sectional shape like a letter "S" is provided so as to extend in a longitudinal direction of the nip forming member 20. The reinforcing member 30 is intended for minimizing flexure of the nip forming member 20 in directions orthogonal to the longitudinal direction which flexure is caused by pressure of the pressurizing roller 50. Between the nip forming member 20 and the reinforcing member 30 is provided a space 32 intended for heat insulation. It is to be noted that the reinforcing member is not limited to that made of a metal plate but may be a solid metal rod, for example.

A plunging guide 60 is provided under the fixing nip 40, and a paper P having an unfixed toner image T formed on a surface thereof is introduced into the fixing nip 40 by the plunging guide 60. Above the fixing nip 40 is provided a pair of ejection guides 62. The ejection guides 62 serve to subserviently guide the paper P ejected from the fixing nip 40 and serve to separate the paper P tending to attach to the fixing belt 12 or the pressurizing roller 50.

When the pressurizing roller 50 is driven to rotate in the direction of the arrow A, in the belt-type fixing device 10 with the configuration described above, the fixing belt 12 concomitantly moves and rotates in a direction of an arrow B while sliding on the surface of the nip forming member 20. While the fixing belt 12 rotates in such a manner, an overall periphery of the fixing belt 12 is heated by the heating roller 14 and temperatures of the fixing belt thereby rise to a specified fixation temperature (e.g., 180° C.).

After the fixing belt 12 is heated so as to have the specified fixation temperature, the paper P having the unfixed toner image T formed on the surface thereof is introduced into the fixing nip 40 from lower side. Thus the toner image T is fixed onto the paper P while the paper is passed through the fixing nip 40. The paper P having passed through the fixing nip 40 is conveyed upward while being guided subserviently by the ejection guides 62, and is then ejected to outside of the image forming apparatus.

Figure 3:
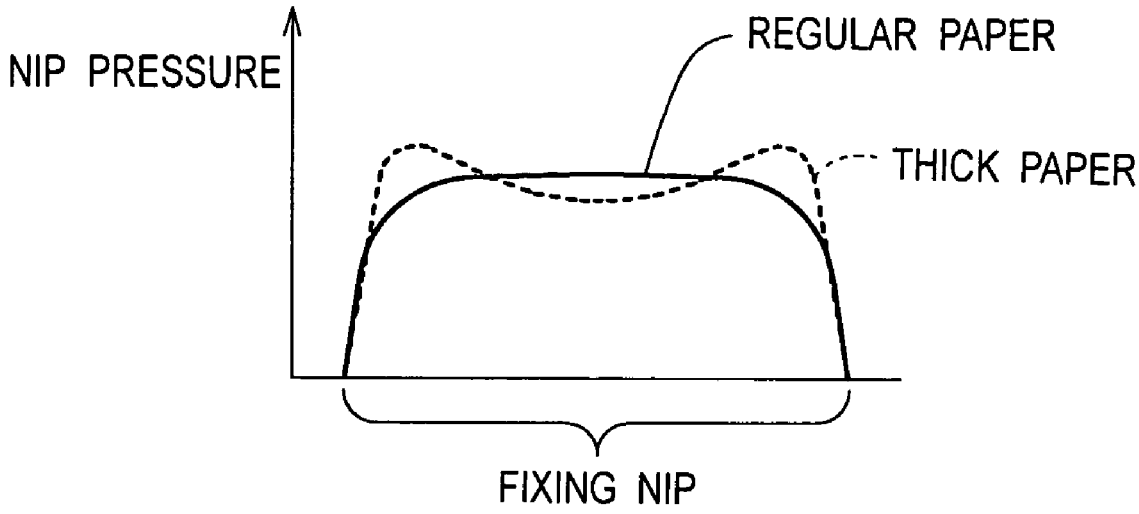
FIG. 3 is a graph illustrating a nip pressure distribution in a fixing nip in FIG. 1.

In accordance with the belt-type fixing device 10 of the embodiment, the nip forming member 20 thus has the elastic layer 20*b*, which deforms on occasion of feeding of a thick paper, so that a pressure distribution in the fixing nip 40 is made generally uniform with respect to the paper feeding direction though being heightened slightly on the entrance side and the exit side in comparison with a case with regular paper, as shown in FIG. 3. As a result, the variation in paper conveying velocity in the fixing nip 40 is restrained. Thus stress is prevented from acting on the paper passing through the fixing nip 40, and image noise such as image blur, wrinkles of paper and the like are thereby prevented from occurring.

Besides, the fixing nip 40 having a desired width (e.g., 12 mm) can be obtained with adequate setting of the width of the nip forming member 20. Accordingly, the fixing nip 40 having a large width is easily obtained by a comparatively small contact pressure, e.g., of 160 to 240 N, in contrast to a conventional fixing device in which a fixing nip is formed between two rollers and which requires a large contact pressure, e.g., of 480 N, for obtainment of a 9 mm-wide fixing nip, for example. Thus nip time required for fixation is ensured by the wide fixing nip 40, so that increase in system speed of the image forming apparatus can be addressed.

The fixing device can be miniaturized and a circumference of the fixing belt 12 can be shortened by substitution of the nip forming member 20 for a fixing roller having an elastic layer on an outer circumference thereof which roller has been used in conventional belt-type fixing devices. Thus the fixing belt 12 can be shortened so that a heat capacity of the fixing belt 12 and heat release from the fixing belt 12 are reduced. Furthermore, substitution of the nip forming member 20, e.g., made of resin with a small heat capacity for a fixing roller having an elastic layer with a large heat capacity increases a rate at which temperature rises in the fixing belt 12 subjected to heat transfer from the heating roller 14. As a result, warm-up time at a start and recovery time from printing-standby status can be shortened.

On condition that a pressure contact load of the pressurizing roller 50 is variable in accordance with a type of a paper, positions of an entrance and an exit of the fixing nip 40 do not change so much as those in a conventional fixing device in which a fixing nip is formed between two rollers. Therefore, deterioration is prevented in performance on plunge of papers into the fixing nip 40 and performance on separation of papers ejected from the fixing nip 40.

With use of the belt-type fixing device 10 of the embodiment, a relation was examined between thicknesses of the elastic layer 20*b* of the nip forming member 20 and occurrence of image noise. In this examination, silicone solid rubber (JIS-A 20°) was used for the elastic layer 20*b* of the nip forming member 20. The low-friction layer 20*c* (PTFE) having a thickness of 0.1 mm was provided on the elastic layer 20*b* of the nip forming member 20, and the radius of curvature of the opposite surface 22 of the nip forming member 20 was 15.4 mm. Thick paper of 210 g/m$^2$ was used for papers.

In the belt-type fixing device 10, as shown in FIG. 4, the elastic layer 20*b* of the nip forming member 20 that had a thickness of 0.1 mm caused image noise, and the layer 20*b* that had a thickness not smaller than 0.3 mm caused no image noise. For prevention of image noise, therefore, the elastic layer 20*b* preferably has a thickness not smaller than 0.3 mm.

With use of the belt-type fixing device 10 of the embodiment, a relation was examined between thicknesses of the elastic layer 20*b* of the nip forming member 20 and durability of the elastic layer 20*b*. In this examination, silicone solid rubber (JIS-A 20°) was used for the elastic layer 20*b* of the nip forming member 20. The low-friction layer 20*c* (PTFE) having a thickness of 0.1 mm was provided on the elastic layer 20*b* of the nip forming member 20, and the radius of curvature of the opposite surface 22 of the nip forming member 20 was 15.4 mm. The fixing belt 12 was heated to 185° C., a continuous operation for 100 hours was carried out, and then presence or absence of fractures in the elastic layer 20*b* was examined.

As shown in FIG. 5, the elastic layer 20*b* of the nip forming member 20 with a thickness up to 2.0 mm underwent no fracture, whereas the layer 20*b* with a thickness not less than 2.5 mm caused fractures in vicinity of an adhesive interface on the base member 20*a* of the nip forming member 20, along with an increase in torque. This is because increase in thickness of the elastic layer 20*b* caused increase in shearing force against a rubber interface owing to sliding load. Therefore, the elastic layer 20*b* of the nip forming member 20 preferably has a thickness not larger than 2.0 mm.

With use of the belt-type fixing device 10 of the embodiment, a relation was examined between thicknesses of the low-friction layer 20*c* on the elastic layer 20*b* and durability of the low-friction layer. 20*c*. In this examination, 0.5 mm-thick silicone solid rubber (JIS-A 20°) was used for the elastic layer 20*b* of the nip forming member 20. The low-friction layer 20*c* was provided on the elastic layer 20*b* of the nip forming member 20. Sprayed and baked glass coating was used as the low-friction layer 20*c*. The radius of curvature of the opposite surface 22 of the nip forming member 20 was 15.4 mm. The fixing belt 12 was heated to 185° C., a continuous operation for 24 hours was carried out, and then an amount of increase in torque was examined.

In the belt-type fixing device 10, as shown in FIG. 6, the low-friction layer 20*c* of the nip forming member 20 that had a thickness of 5 μm or more resulted in an amount of torque increase of 0.1 Nm or less, which was within tolerance. The layer 20*c* with a thickness of 2 μm, however, caused torque to increase by 0.45 Nm. This is because the glass coating was worn away so that the elastic layer 20*b* was exposed. Therefore, the low-friction layer 20*c* preferably has a thickness not smaller than 5 μm.

With use of the belt-type fixing device 10 of the embodiment, a relation was examined between thicknesses of the low-friction layer 20*c* on the elastic layer 20*b* and image noise. In this examination, 0.5 mm-thick silicone solid rubber (JIS-A 20°) was used for the elastic layer 20*b* of the nip forming member 20. A PTFE film was used as the low-friction layer 20*c*. A radius of curvature of the opposite surface 22 of the nip forming member 20 was 15.4 mm. Thick paper of 210 g/m$^2$ was used for papers.

In the belt-type fixing device 10, as shown in FIG. 7, the low-friction layer 20*c* of the nip forming member 20 that had a thickness not larger than 0.3 mm caused no image noise even on a thick paper, and the low-friction layer 20*c* that had a thickness of 0.4 mm caused image noise. Therefore, the low-friction layer 20*c* preferably has a thickness not larger than 0.3 mm.

Figure 8:
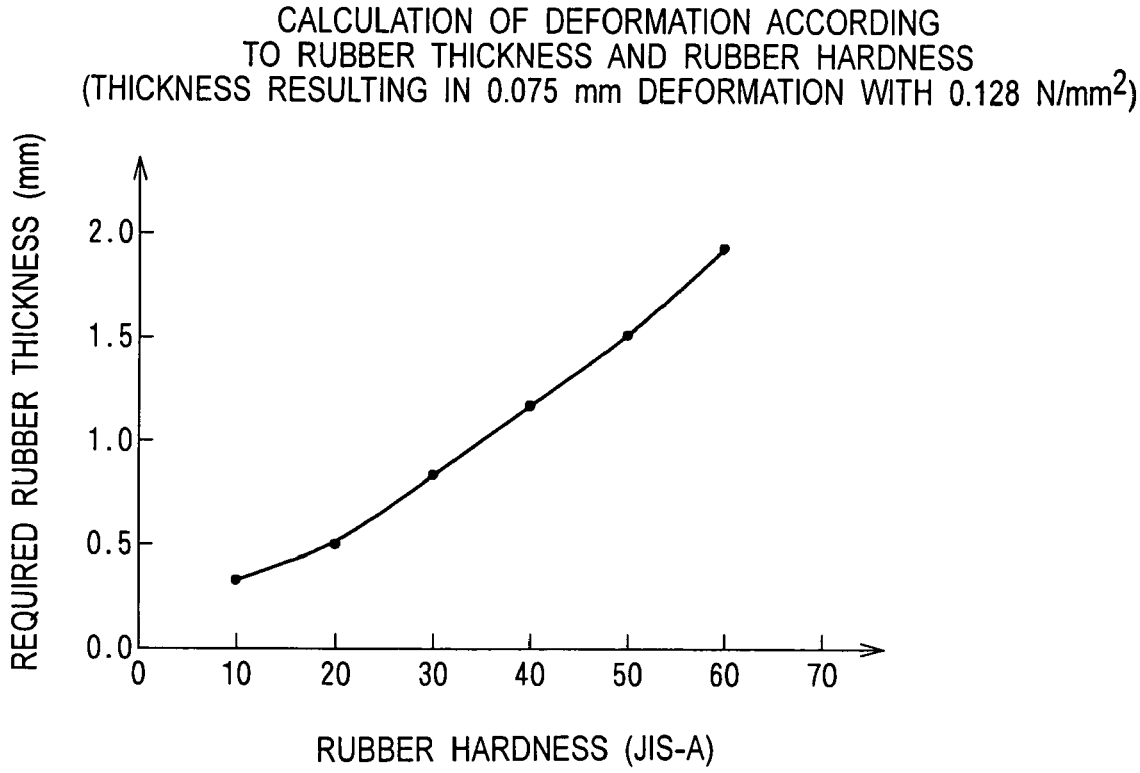
FIG. 8 is a graph showing a relation between rubber thickness and rubber hardness.

On condition that a quantity of deformation of the elastic layer 20*b* of the nip forming member 20 is larger than a quantity of deformation of the elastic layer 54 of the pressurizing roller 50, a curvature at the exit of the fixing nip 40 is decreased and a problem is thereby caused in that separability and curl of papers deteriorate. Accordingly, the quantity of deformation of the elastic layer 54 of the pressurizing roller 50 is preferably larger than the quantity of deformation of the elastic layer 20*b* of the nip forming member 20. For obtainment of those proper quantities of deformation, required rubber thickness and required rubber hardness are preferably set with use of a graph shown in FIG. 8, for example. The graph shown in FIG. 8 shows a relation between rubber thickness and rubber hardness that are required for obtainment of a quantity of rubber deformation of 0.075 mm with a pressure of 0.128 N/mm$^2$.

Hereinbelow, a belt-type fixing device 11 in accordance with a second embodiment will be described. A configuration of the belt-type fixing device 11 is generally the same as that of the belt-type fixing device 10 shown in FIG. 1 but is different in following respects.

Figure 9:
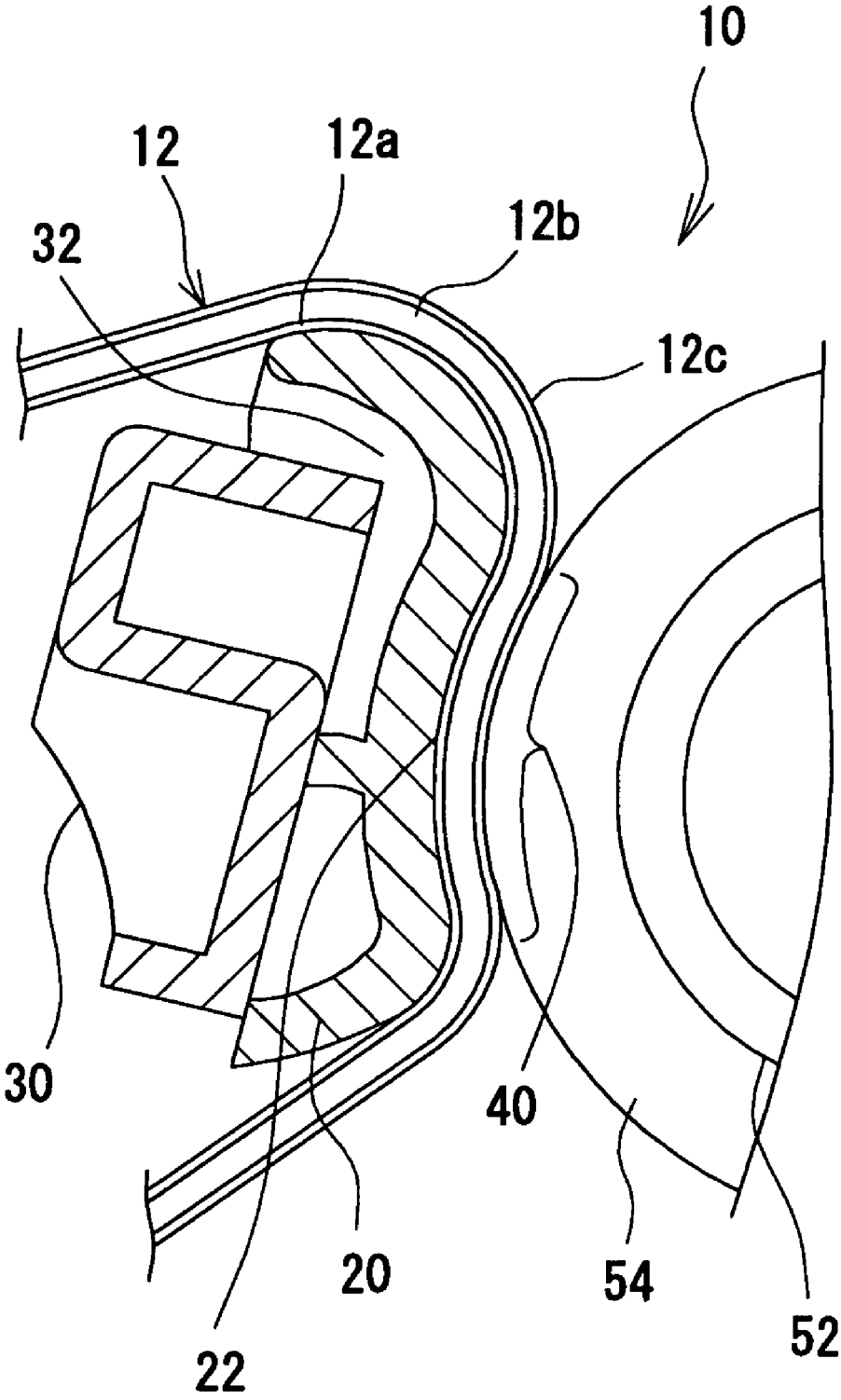
FIG. 9 is a fragmentary enlarged view of a fixing belt in a belt-type fixing device in accordance with a second embodiment.
Figure 12:
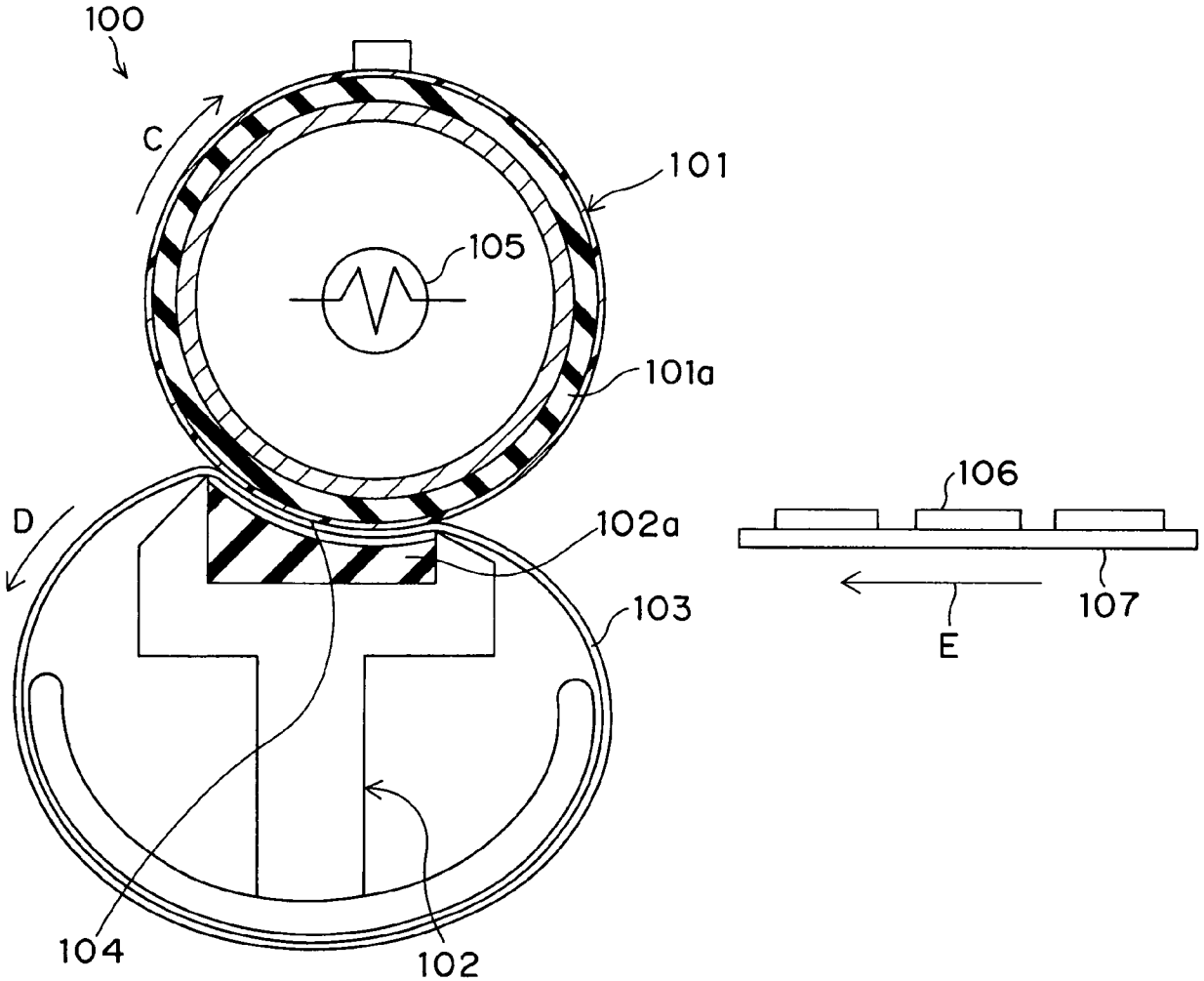
Fig.12 PRIOR ART
FIG. 12 is a diagram illustrating an example of a conventional belt-type fixing device.

In the belt-type fixing device 11, an elastic layer is not provided on a nip forming member 20, and a low-friction layer (not shown), e.g., composed of PFA, PTFE or the like is formed on a surface of the nip forming member 20 that abuts on an inner surface of a fixing belt 12. On the other hand, the fixing belt 12 includes an elastic layer 12*b* as shown in FIG. 9. The fixing belt 12 has an outside diameter of 50 mm in form of a cylinder, and is composed of a 35 μm-thick base material 12*a* made of nickel (Ni), the 500 μpm-thick elastic layer 12*b* made of silicone rubber, and a 30 μm-thick mold release layer 12*c* made of PFA, for example, which are superimposed in order of mention from inside.

Configurations of other parts of the belt-type fixing device 11 are precisely the same as those of the above belt-type fixing device 10, and description thereof is therefore omitted with the same elements designated by the same reference characters. Operations of the belt-type fixing device 11 are precisely the same as those of the belt-type fixing device 10, and description thereof is therefore omitted.

Effects of the belt-type fixing device 11 of the embodiment are also the same as those of the belt-type fixing device 10. That is, one of effects of the belt-type fixing device 11 is as follows. On the base material 12*a* of the fixing belt 12 is provided the elastic layer 12*b*, which deforms on occasion of feeding of a thick paper, so that a nip pressure distribution in a fixing nip 40 is made generally uniform with respect to a paper feeding direction though being heightened slightly on entrance side and exit side in comparison with a case with regular paper, as shown in FIG. 3. As a result, variation in paper conveying velocity in the fixing nip 40 is restrained.

Thus a paper passing through the fixing nip 40 is prevented from being stressed, and image noise such as image blur, wrinkles of paper and the like are thereby prevented from occurring.

With use of the belt-type fixing device 11, a relation was examined between thicknesses of the elastic layer 12*b* of the fixing belt 12 and occurrence of image noise. In this examination, silicone solid rubber (JIS-A 20°) was used for the elastic layer 12*b* of the fixing belt 12. The nip forming member 20 was composed of a base member of PPS (polyphenylene sulfide) and the 0.1 mm-thick low-friction layer (PTFE) provided on the base member, and a radius of curvature of an opposite surface 22 of the nip forming member 20 was 15.4 mm. Thick paper of 210 g/m$^2$ was used for papers.

In the belt-type fixing device 11, as shown in FIG. 10, the elastic layer 12*b* of the fixing belt 12 that had a thickness of 0.1 mm and 0.2 mm caused image noise, and the layer 12*b* that had a thickness of 0.3 to 1.0 mm caused no image noise. For prevention of image noise, therefore, the elastic layer 12*b* preferably has a thickness not smaller than 0.3 mm.

With use of the belt-type fixing device 11, a relation was examined between thicknesses of the elastic layer 12*b* of the fixing belt 12 and durability of the fixing belt 12. In this examination, silicone solid rubber (JIS-A 20°) was used for the elastic layer 12*b* of the fixing belt 12. The nip forming member 20 was composed of the base member of PPS and the 0.1 mm-thick low-friction layer (PTFE) provided on the base member, and a radius of curvature of the opposite surface 22 of the nip forming member 20 was 15.4 mm. The fixing belt 12 was heated to 185° C., a continuous operation for 24 hours was carried out, and then presence or absence of fractures in the belt was examined.

As shown in FIG. 11, the elastic layer 12*b* of the fixing belt 12 with a thickness up to 1.0 mm caused no fracture in the belt, whereas the layer 12*b* with a thickness not less than 1.2 mm caused waves and cracks in the fixing belt 12 with endurance. This is because, with increase in thickness of the elastic layer 12*b*, thermal resistance of the fixing belt 12 increased and temperature of the base material 12*a* composed of nickel in the fixing belt 12 increased and exceeded a heat-resisting limit of nickel. Therefore, the elastic layer 12*b* of the fixing belt 12 preferably has a thickness not larger than 1.0 mm.

It is to be noted that, in the belt-type fixing devices 10 and 11, the fixing belt 12 is heated by the heating roller 14 having the heater lamp 16 therein; however, the heater lamp 16 may be provided in the pressurizing roller 50. An unfixed toner image T formed on a paper P may be fixed in contact with the pressurizing roller 50.

Though the rotatable heating roller 14 is used as the heating member in the belt-type fixing devices 10 and 11, a sheet-like heater that cannot be rotated may be substituted for the heating roller 14. In this configuration, the fixing belt 12 is wound around the curved sheet-like heater and around the nip forming member 20, and the fixing belt 12 that is sliding on the sheet-like heater is heated by the same.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A belt-type fixing device comprising:

an endless-sheet-like fixing belt, a pressurizing roller which has elasticity and on which a paper is passed through a fixing nip that is a contact part between the pressurizing roller and an outer circumferential surface of the fixing belt, and a one-piece nip forming member which is provided in contact with an inner surface of the fixing belt, which relatively presses the fixing belt against the pressurizing roller, of which an opposite surface pressing the pressurizing roller is formed as a curved surface extending along an outer circumferential surface of the pressurizing roller, and of which the opposite surface is composed of an elastic layer, wherein the only fixing nip is formed by the one-piece nip forming member.

2. A belt-type fixing device as claimed in claim 1, wherein the elastic layer of the nip forming member has a thickness of 0.3 to 2.0 mm.

3. A belt-type fixing device as claimed in claim 1, wherein a low-friction layer having a thickness of 5 to 300 μm is provided on the elastic layer of the nip forming member.

4. A belt-type fixing device as claimed in claim 1, wherein a quantity of deformation of the pressurizing roller is larger than a quantity of deformation of the elastic layer of the nip forming member.

5. A belt-type fixing device as claimed in claim 1, wherein the fixing belt is driven to rotate by the pressurizing roller that is driven to rotate.

6. A belt-type fixing device as claimed in claim 1, further comprising a heating roller, wherein the fixing belt is wound around the nip forming member and around the heating roller.

7. A belt-type fixing device comprising:

an endless-sheet-like fixing belt including an elastic layer, a pressurizing roller which has elasticity and on which a paper is passed through a fixing nip that is a contact part between the pressurizing roller and an outer circumferential surface of the fixing belt, a one-piece nip forming member which is provided in contact with an inner surface of the fixing belt, which relatively presses the fixing belt against the pressurizing roller, and of which an opposite surface pressing the pressurizing roller is formed as a curved surface extending along an outer circumferential surface of the pressurizing roller, wherein the only fixing nip is formed by the one-piece nip forming member.

8. A belt-type fixing device as claimed in claim 7, wherein the elastic layer of the fixing belt has a thickness of 0.3 to 1.0 mm.

9. A belt-type fixing device as claimed in claim 7, wherein a mold release layer is provided on the elastic layer in the fixing belt.

10. A belt-type fixing device as claimed in claim 7, wherein the fixing belt is driven to rotate by the pressurizing roller that is driven to rotate.

11. A belt-type fixing device as claimed in claim 7, further comprising a heating roller, wherein the fixing belt is wound around the nip forming member and around the heating roller.

12. A belt-type fixing device comprising:

an endless-sheet-like fixing belt, a pressurizing roller which has elasticity and on which a paper is passed through a fixing nip that is contact part between the pressurizing roller and an outer circumferential surface of the fixing belt, a one-piece nip forming member which is provided in contact with an inner surface of the fixing belt, which relatively presses the fixing belt against the pressurizing roller, and of which an opposite surface pressing the pressurizing roller is formed as a curved surface extending along an outer circumferential surface of the pressurizing roller, and an elastic member which is provided in contact part of the nip forming member abutting on the fixing belt and of which a surface opposite to the pressurizing roller has a radius of curvature substantially equal to a radius of curvature of the outer circumferential surface of the pressurizing roller, wherein the only fixing nip is formed by the one-piece nip forming member.

* * * * *